United States Patent [19]

Tarro

[11] 4,339,053

[45] Jul. 13, 1982

[54] CONTAINER WITH ATTACHED PULL TAB OPENER AND INDICATOR

[76] Inventor: Richard E. Tarro, 425 Broadway, Providence, R.I. 02909

[21] Appl. No.: 120,671

[22] Filed: Feb. 11, 1980

Related U.S. Application Data

[63] Continuation-in-part of Ser. No. 940,354, Sep. 7, 1978, Pat. No. 4,234,099, Continuation-in-part of Ser. No. 422,265, Dec. 6, 1973, Continuation-in-part of Ser. No. 603,590, Aug. 11, 1975, Pat. No. 4,008,823, Continuation-in-part of Ser. No. 744,196, Nov. 22, 1976, abandoned.

[51] Int. Cl.[3] ..... B65D 17/34

[52] U.S. Cl. ..... 220/269; 220/336; 220/258

[58] Field of Search ..... 220/260, 269, 270, 359, 220/214, 336, 258; 215/250, 232, 246

[56] References Cited

U.S. PATENT DOCUMENTS

| | | | |
|---|---|---|---|
| 3,204,805 | 9/1965 | May | 220/258 X |
| 3,813,000 | 5/1974 | Underwood | 220/269 |
| 3,847,300 | 11/1974 | Waters | 220/269 |

*Primary Examiner*—George T. Hall
*Attorney, Agent, or Firm*—Salter & Michaelson

[57] ABSTRACT

A container having a pull tab secured to a scored removable section. A pivot member tethers the removable section to the container top after the can is opened by pulling the tab. An indicator is provided to show that the container has been opened. The indicator is in the form of a strip adhesively attached to the top across the tear strip so that when the can is opened, the indicator is torn and one or more pieces remain in the top as an indication that the can has been opened. In addition, other forms of indicators such as chemical, may be used. The indicators can be used on the conventional can openers or on cans having other devices such as sanitary drinking portions.

9 Claims, 9 Drawing Figures

FIG. 1
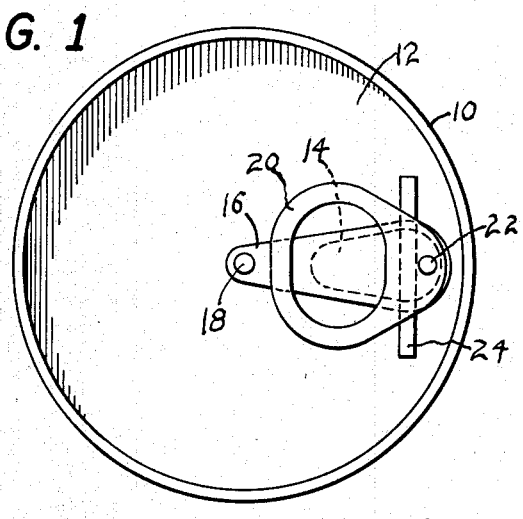
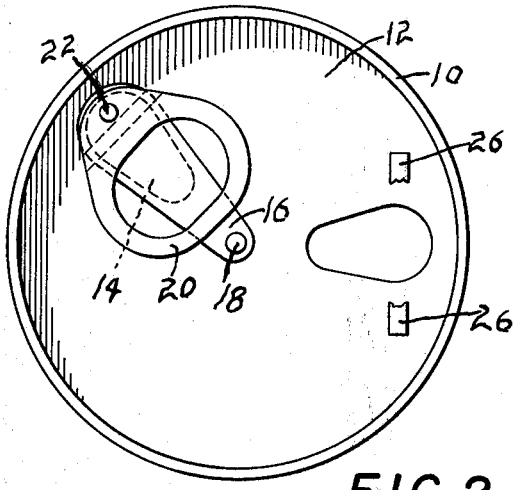
FIG. 2
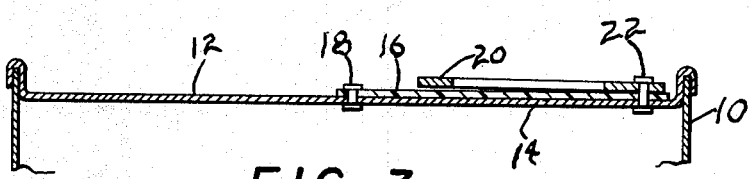
FIG. 3
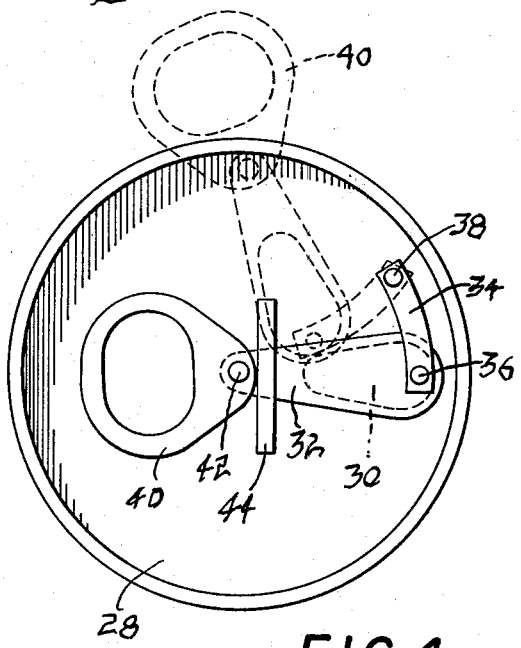
FIG. 4
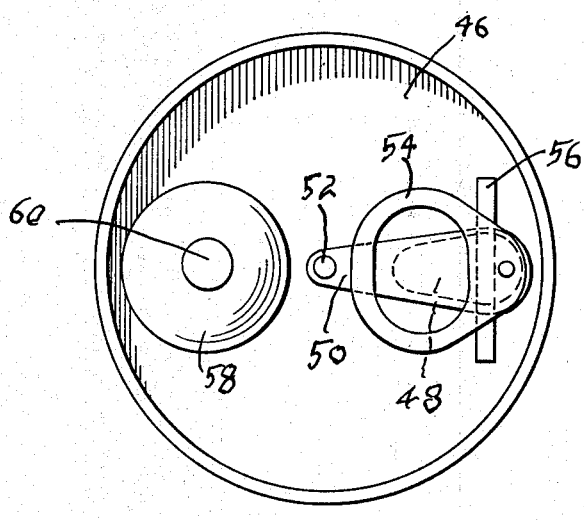
FIG. 5

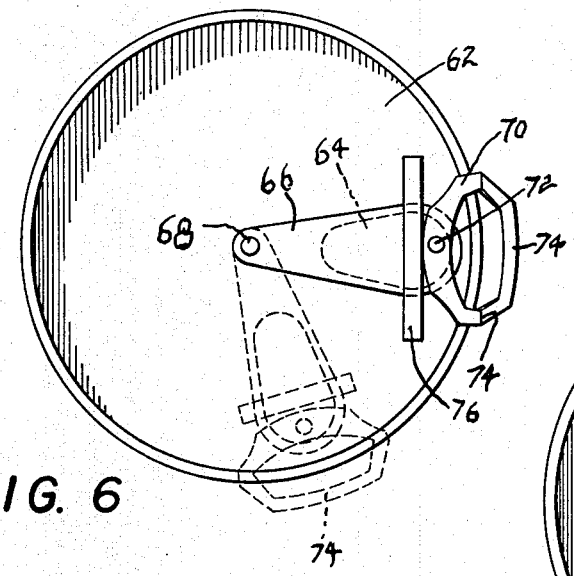
FIG. 6
FIG. 7
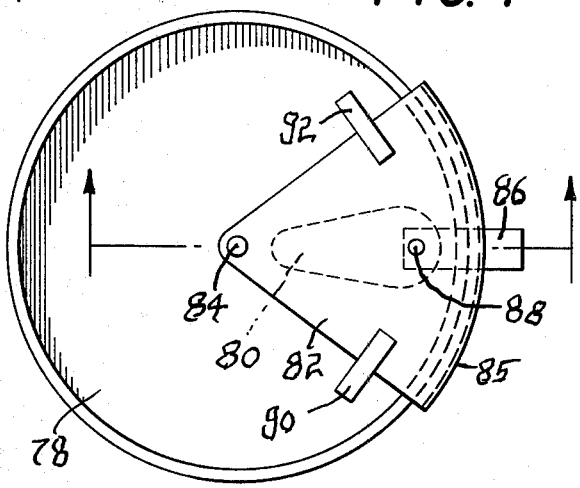
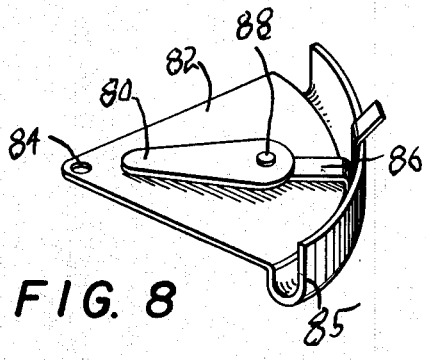
FIG. 8
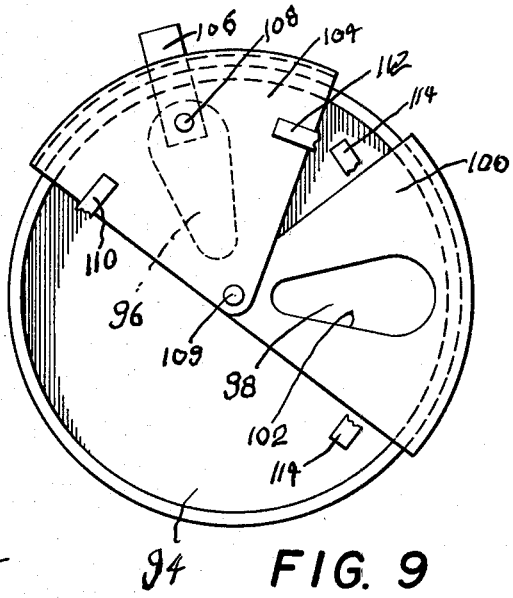
FIG. 9
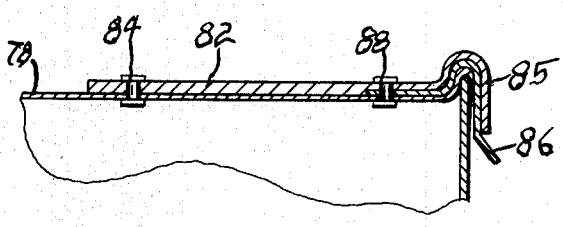
FIG. 10

CONTAINER WITH ATTACHED PULL TAB OPENER AND INDICATOR

BACKGROUND OF THE INVENTION

This application constitutes a continuation in part of my copending application Ser. No. 940,354, filed Sept. 7, 1978, now U.S. Pat. No. 4,234,099 and entitled Container With Attached Pull Tab Opener, and also continuations in part of my applications Ser. No. 422,265, filed Dec. 6, 1973, Ser. No. 603,590, filed Aug. 11, 1975, now U.S. Pat. No. 4,008,823, and Ser. No. 744,196, Filed Nov. 22, 1976, now abandoned, all entitled Container With Attached Pull Tab Opener.

Most easy opening containers or cans provide a metal top with a scored portion which can be removed. A pull tab is attached to this portion so that when the tab is pulled, the scored portion is torn out and discarded leaving a pouring opening. In my application Ser. No. 422,265, a construction was shown in which the scored portion was pivotally tethered to the can top so that the small sharp piece would stay on the can and not become an ecological problem. In Ser. No. 940,354, the construction showed a quick opening can which was releasable after opening. The various constructions also provided means for indicating when the can had been opened and resealed. The group of cans shown in these applications also showed the use of an indicator on non-resealable can constructions. The present application is directed to this group.

SUMMARY OF THE INVENTION

The present invention provides an improvement over the basic construction of the tethered pull tab and scored portion by adding means for indicating whether the can has been opened. The indicator may be provided by pasting, bonding or otherwise attaching a strip of paper or similar material across the scored portion and on to the can top. When the can is opened by tearing the scored portion, the strip will also be torn to indicate the opening. Other visual means may also be used for the purpose. For example, chemical portions on the top can be made to crack up when the can is opened. Other can constructions, such as cans with sanitary drinking edges, can also be similarly provided with the indicators.

DESCRIPTION OF THE DRAWINGS

In the drawings

FIG. 1 is a top plan view of a tethered tear strip construction having an indicating device of the present invention;

FIG. 2 is a view similar to FIG. 1 with the device in open position;

FIG. 3 is an enlarged section across the top of the can shown in FIG. 1;

FIG. 4 is a view similar to FIG. 1 showing another form of pull tab opener with an indicator of the present invention;

FIG. 5 is a view similar to FIG. 1 showing an additional indicating device added to the can top;

FIG. 6 is a view similar to FIG. 1 showing an indicator applied to a can with a locking device;

FIG. 7 is a top plan view of the indicator applied to an opener with a sanitary drinking feature;

FIG. 8 is a perspective view of the closure member for the device shown in FIG. 7;

FIG. 9 is a view similar to FIG. 7 showing another form of sanitary drinking device in open position; and FIG. 10 is a section of the device shown in FIG. 7.

DESCRIPTION OF THE INVENTION

The present invention basically provides an easy opening container in which the portion of the metal that is removed to form the opening remains attached to the container and is not discarded independently thereof. In Ser. No. 940,354 the can was shown with a resealable construction and an indicating device as added to show when it had been opened. The present invention is limited to the use of the indicator on a non-resealable can.

Referring to FIGS. 1, 2 and 3, the can 10 is provided with the metal top 12 having the scored portion 14 for opening the can. An elongated pivot member 16 has its inner end riveted at 18 to the can top 12 and extends across the top to completely cover the scored portion 14. The member 16 is bonded to the portion 14 and the pull tab 20 is attached by passing the rivet 22 through both the member 16 and the portion 14. When the tab is pulled to tear the portion 14 from the top, it remains attached to the member 16. It can thus be swung out of the way as shown in FIG. 2. An indicator is also used to show that the can has been opened.

A strip of paper, plastic or similar material 24 is glued or bonded to the top adjacent to the pull tab rivet 22 and extends transversely across the scored portion 14 and beneath the tab 20, see FIG. 1. When the can is opened, FIG. 2, the strip 24 is torn, leaving ragged edged pieces 26 on the top on each side of the opening. If desired, the material of the strip 24 may be of a different color on the outside than the inside to provide an immediate contrast. Also, a chemical can be used on the inside which will change color after the strip is torn.

FIG. 4 is a view similar to FIG. 1 showing an indicator used on a can construction in which the position of the tab is reversed so that the can is opened from the center outwardly. In this form the can top 28 is provided with the scored portion 30. The pivot member 32 extends over and is bonded to the scored portion 30. An arcuate pivot member 34 is riveted at one end 36 to the scored portion 30 through the member 32. The other end of the pivot member 34 is pivotally riveted at 38 to the can top 28. The pull tab 40 is riveted to the inner end of the member 32 at 42.

Now, when the pull tab 40 is pulled upwardly, the scored portion 30 is torn out to open the can. The entire assembly can then be swung to one side as shown in the dotted lines to expose the opening. The indicator comprises a strip 44 bonded or glued to the top transversely across the member 32 adjacent the tab rivet 42. When the tab and member 32 are pulled upwardly to open the can, the strip 44 is torn to indicate the opening as in the form shown in FIG. 1.

FIG. 5 illustrates an additional type of indicator which can be used with the indicator shown in FIG. 1 or can be used independently without it. This indicator is particularly applicable where the can is under pressure, either internal or external (vacuum). For illustration, the can is shown with the top 46 provided with the scored portion 48, pivot member 50, pivotally mounted at 52 to the can top, pull tab 54, and indicator 56. As an additional or separate indicator, the can top is provided with an annular portion 58 which is pressed inwardly in a vacuum packed can and pressed outwardly in a pressurized can. When the can is opened, the portion 58 will snap upwardly (vacuum) or inwardly (pressure) to indicate that the can has been opened. As an added indicator, the center of the portion 58 may be provided with a chemical spot 60 similar to a brittle enamel. Snapping of the portion 58, in or out, will fracture the spot 60 so that it will present a splintered appearance. If desired, the inner portion of the spot may be of a different color for effect. Further, the inner portion of the spot may be oxidizable when the surface is fractured to expose a noticable color.

FIG. 6 illustrates the use of the indicator on a can in which the scored portion may be locked out of the way for drinking. The top 62 has the scored portion 64 for opening the can. The pivot member 66 has its inner end riveted at 68 to the top and extends across the top to cover the scored portion 64. The member 66 is bonded to the portion 64 and the pull tab 70 is attached by passing a rivet 72 through both members. When the tab is pulled to tear the portion 64 from the top, the member 66 remains attached and can be swung out of the way to permit pouring or drinking. The tab 70 is sharply bent at 74 to snap over the edge of the can to hold it in place in open position. If the member 66 is elastic, tension will assist in holding the tab over the edge. An indicator strip 76 is bonded transversely across the member 66 adjacent to the pull tab 70. When the tab is pulled upwardly to open the can, the strip 76 will be torn to indicate that the can has been opened.

The arrangement shown in FIGS. 7 and 8 is a modified version of the form shown in FIG. 1 providing a sanitary drinking area on the can. The can top 78 is provided with a scored portion 80 for forming the opening. A triangular member, preferably of a plastic material, 82 is attached at its apex 84 to the can top, FIG. 7. It is bonded to the top of the scored portion 80. The member 82 has a thin inverted U-shaped edge 85 for snapping over the edge of the can in closed position. The pull tab 86 is attached under the portion 82 to a rivet 88 which passes through the tab, scored portion, and member 82. If desired, the tab 86 can be imbedded in the member 82 for a more sanitary arrangement. The tab is also elongated to avoid interference with the six pack carton. When the tab is lifted, it will lift the member 82 and tear the portion 80 from the top. The assembly can be swung to one side and locked to one side to allow drinking. The member 82 thus covers and keeps clean the drinking portion of the can top before opening.

This form is also provided with indicating means. Two strips 90 and 92 are bonded to the can top at each side edge of the member 82 to overlied the member 82 and the can top 78. When the tab is lifted to open the can, the strips 90 and 92 will both be torn to show the opening of the can.

FIG. 9 illustrates the form shown in FIGS. 7 and 8 with an additional sanitary feature. In this form, the can top 94 is provided with a scored portion 96 for forming the opening 98. A generally triangular base plastic member 100 is bonded to the top of the can 94 and has a cut out portion 102 aligned with the edge of the scored portion 96. At the edge, the member 100 thins down to form a plastic coating over the edge of the can. When the can is used for drinking, the mouth will touch the plastic coat rather than the metal of the can.

The closure member in this form comprises a triangular member 104 attached at the apex 108 to the can top. It is bonded to the top of the scord portion 96. As in the form shown in FIG. 7, the member 104 is provided with a U-shaped edge for snapping over the edge of the can. The pull tab 106 is attached under the member 104 to a rivet 109 which passes through the tab, scored portion, and member 104. When the tab is lifted, it will lift the member 104 and tear the portion 96 from the top. The assembly can be swung to one side for drinking from the opening 98. The indicators in this form comprise two strips (one can be used) 110 and 112 bonded to the top of the can at each side edge of the member 104 to overlie the can and member. When the tab is lifted to open the can, the strips 110 and 112 will be torn to show that the can has been opened. The residual strip pieces 114 left on place provide visual evidence ot the opening.

While I have described the indicators in use on a can having a tethered tear strip, it is obvious that the indicators can readily be used on the conventional tear strip can without tethers. This is especially true of the indicator shown in FIG. 5. This indicator will show the opening of a pressurized can or any break in the can seal. This is important where the contents can alter when exposed to the atmosphere.

Other advantages of the present invention will be readily apparent to a person skilled in the art.

I claim:

1. A pull tab opener device for a container, comprising a body, a metal top joined to said body, a scored portion formed on said top and outlining an opening of generally oval shape that is located adjacent to an edge of said top, a pull tab interconnected to said scored portion at an end thereof and that is operable to tear said scored portion from said top for exposing said opening and the contents of said container, and frangible indicating means mounted on said top and being fractured by the movement of said pull tab upon removal of said scored portion, at least a portion of said indicating means remaining attached to said top and being visible after removal of said scored portion when said top is opened to indicate that said container has been opened and/or used.

2. A pull tab opener device as claimed in claim 1, said frangible indicating means being defined by an elongated strip of material, at least a portion of which is bonded to said scored portion, wherein said strip of material is fractured when said scored portion is torn from said top thereby indicating that said container has been opened and/or used.

3. A pull tab opener device as claimed in claim 1, said frangible indicating means including an elongated strip of material that overlies said scored portion in transverse relation, said strip being fractured when said scored portion is torn from said top by said pull tab such that spaced end portions remain secured to said top to indicate that said container has been opened and/or used.

4. A pull tab opener device for a container having a metal top comprising a scored portion outlining the opening of a generally oval shape aligning axially with a radius of the top, a pull tab attached to said scored portion adjacent one end thereof, and means for indicating that said container has been opened, a portion of said means remaining on said top after said container has been opened, said top being provided with an indicating area that is biased from the horizontal by either internal or external pressure, said area snapping back to the horizontal when said scored portion has been opened.

5. A pull tab opener device for a container having a metal top comprising a scored portion outlining the opening of a generally oval shape aligning axially with a radius of the top, a pull tab attached to said scored portion adjacent one end thereof, and means for indicating that said container has been opened, a portion of said means remaining on said top after said container has been opened, wherein means are provided for attaching said scored portions to the top, said means including a plastic strip having one end pivotally attached to the top, said strip being bonded to said scored portion, said top being provided with an indicating area biased from the horizontal by either internal or external pressure, said area snapping back to the horizontal when the can is opened.

6. A device as in claim 4, wherein said indicating means includes a spot of chemical material hardened to the center of said area, whereby said spot will crack when said container is opened.

7. A device as in claim 5, wherein said indicating means includes a spot of chemical material hardened to the center of said area, whereby said spot will crack when said container is opened.

8. A pull tab opener device for a container having a metal top comprising a scored portion outlining the opening of a generally oval shape aligning axially with a radius of the top, a pull tab attached to said scored portion adjacent one end thereof, and means for indicating that said container has been opened, at least a portion of said indicating means remaining attached to said top and being visible after said container has been opened, said pull tab being provided with a portion that is bent over the edge of the container to extend below the edge, said bent portion snapping over the edge of the container to retain said pull tab in open position.

9. A pull tab opener device for a container having a metal top comprising a scored portion outlining the opening of a generally oval shape aligning axially with a radius of the top, a pull tab attached to said scored portion adjacent one end thereof, and means for indicating that said container has been opened, a portion of said means remaining on said top after said container has been opened, said pull tab being provided with a portion that is bent over the edge of the container to extend below the edge, said bent portion snapping over the edge of the container to retain said pull tab in open position, said attaching means comprising a plastic triangular member pivotally attached to the container top and having an extension over the edge of the container to form a sanitary drinking area, said indicator means comprising a strip of material overlying the side edge of said triangular member.

* * * * *